US010314363B2

(12) United States Patent
Takahashi et al.

(10) Patent No.: US 10,314,363 B2
(45) Date of Patent: Jun. 11, 2019

(54) INSOLE FOR SHOE

(71) Applicant: BMZ. Inc, Tone-gun, Gunma (JP)

(72) Inventors: Tsuyoshi Takahashi, Gunma (JP); Kimihiko Kanazawa, Numata (JP); Shigeki Takahashi, Gunma (JP); Takeo Sayama, Yokohama (JP); Norihisa Okumura, Sapporo (JP); Shouta Kaneko, Sapporo (JP); Yuichi Takata, Sapporo (JP)

(73) Assignee: BMZ. Inc, Tone-gun, Gunma (JP)

( * ) Notice: Subject to any disclaimer, the term of this patent is extended or adjusted under 35 U.S.C. 154(b) by 183 days.

(21) Appl. No.: 14/891,914

(22) PCT Filed: Jun. 21, 2013

(86) PCT No.: PCT/JP2013/067121
§ 371 (c)(1),
(2) Date: Nov. 17, 2015

(87) PCT Pub. No.: WO2014/203399
PCT Pub. Date: Dec. 24, 2014

(65) Prior Publication Data

US 2016/0095382 A1 Apr. 7, 2016

(51) Int. Cl.

| | |
|---|---|
| ***A43B 7/14*** | (2006.01) |
| ***A43B 17/00*** | (2006.01) |
| ***A43B 17/02*** | (2006.01) |

(52) U.S. Cl.
CPC ..... *A43B 7/143* (2013.01); *A43B 7/144* (2013.01); *A43B 17/00* (2013.01); *A43B 17/006* (2013.01); *A43B 17/02* (2013.01)

(58) Field of Classification Search
CPC ..... A43B 7/143; A43B 7/144; A43B 7/1435
See application file for complete search history.

(56) References Cited

U.S. PATENT DOCUMENTS 1,746,002 A * 2/1930 Lobel ..... A43B 7/14 36/180
2,154,997 A * 4/1939 Schipper ..... A43B 7/1415 36/166
2,221,202 A * 11/1940 Ratcliff ..... A43B 7/14 36/155

(Continued)

FOREIGN PATENT DOCUMENTS

CN 200941845 Y 9/2007
EP 2241207 A1 10/2010

(Continued)

OTHER PUBLICATIONS

Office Action for the corresponding Chinese application No. 201380076510.0 dated Jul. 21, 2016 together with English Translation.

(Continued)

*Primary Examiner* — Jila M Mohandesi
(74) *Attorney, Agent, or Firm* — Muncy, Geissler, Olds & Lowe, P.C.

(57) ABSTRACT

Provided is an insole capable of supporting a foot in a well-balanced manner.
An insole 1 for a shoe is configured to include a calcaneal anterior-part support protrusion 90 for supporting a calcaneal anterior part 12A from a sole.

6 Claims, 8 Drawing Sheets

(56) References Cited

U.S. PATENT DOCUMENTS

| | | | | | |
|---|---|---|---|---|---|
| 3,265,071 | A * | 8/1966 | Kirchner | A43B 7/142 36/145 |
| 3,470,880 | A * | 10/1969 | Pagliano | A43B 7/1415 36/178 |
| 4,686,994 | A * | 8/1987 | Harr | A43B 7/142 36/145 |
| 5,129,395 | A * | 7/1992 | Hoffmann | A43B 7/14 36/145 |
| 5,164,878 | A * | 11/1992 | Hauser | A43B 7/142 36/155 |
| 5,388,351 | A * | 2/1995 | Mitchell | A43B 7/142 36/145 |
| 2003/0033730 | A1 | 2/2003 | Burke et al. | |
| 2006/0000120 | A1 * | 1/2006 | Chenut | A43B 7/142 36/144 |
| 2006/0288613 | A1 | 12/2006 | Lo | |
| 2012/0260525 | A1 | 10/2012 | Kim | |

FOREIGN PATENT DOCUMENTS

| | | | |
|---|---|---|---|
| JP | 2006-102335 | A | 4/2006 |
| JP | 4733957 | B | 4/2006 |
| JP | 2010-125100 | A | 6/2010 |
| JP | 5070445 | B2 | 8/2012 |
| KR | 20-0370683 | Y | 12/2004 |
| KR | 10-0935578 | B1 | 1/2010 |
| KR | 20-2012-0003299 | U | 5/2012 |
| TW | I314043 | B | 9/2009 |
| WO | 94/19978 | A1 | 9/1994 |

OTHER PUBLICATIONS

Extended European Search Report of European patent application No. 13887476 dated Jan. 24, 2017.

Korean Office Action of Korean patent application No. 10-2015-7032392 dated Mar. 6, 2017 (with English Machine Translation).

International Search Report of PCT/JP2013/067121 (dated Jul. 16, 2013).

International Preliminary Report on Patentability for PCT/JP2013/067121 dated Dec. 30, 2015.

Written Opinion of the International Searching Authority dated Jul. 16, 2013.

Office Action of the corresponding Korean application No. 10-2015-7032392 dated Sep. 29, 2017 and English translation thereof.

Office Action of the corresponding Korean application No. 10-2015-7032392 dated Mar. 30, 2018 and English machine translation thereof.

Office Action of the corresponding EP application No. 13887476.3 dated Mar. 16, 2018.

* cited by examiner

FIG.3A
S1-S1 SECTION
FIG.3B
S2-S2 SECTION
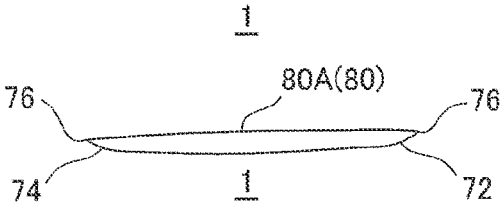
FIG.3C
S3-S3 SECTION
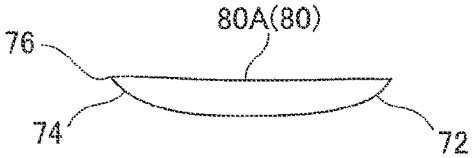
FIG.3D
S4-S4 SECTION
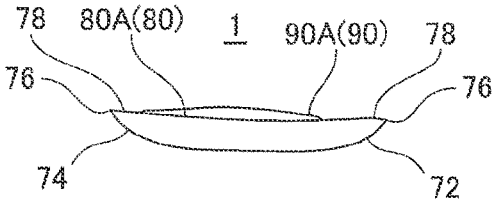
FIG.3E
S5-S5 SECTION
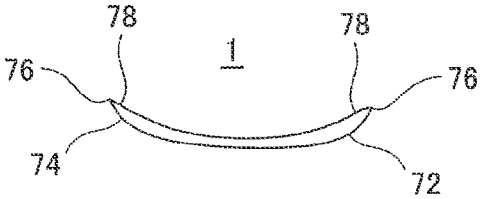

INSOLE FOR SHOE

TECHNICAL FIELD

The present invention relates to an insole for a shoe.

BACKGROUND ART

Conventionally, in an insole for a shoe, there is known an insole that includes a cuboid bone support protrusion that supports, with a cuboid bone being a fulcrum, a foot from the sole thereof, wherein a foot skeleton balance is adjusted by the cuboid bone support protrusion to permit a foot movement with a cuboid bone being a fulcrum (see Patent Literature 1, for example).

CITATION LIST

Patent Literature

[PTL 1] Japanese Patent Publication No. 4733957

SUMMARY OF INVENTION

Technical Problem

In the above-described conventional insole, a foot balance is adjusted by the cuboid bone support protrusion that supports the cuboid bone; however, it is desired to support a foot in a better-balanced manner.

The present invention has been achieved in view of the above-described circumstance, and an object thereof is to provide an insole for a shoe capable of supporting a foot in a well-balanced manner.

Solution to Problem

To achieve the above-described object, an insole for a shoe of the present invention includes a calcaneal anterior-part support protrusion for supporting a calcaneal anterior part from a sole.

In the above-described configuration, the calcaneal anterior-part support protrusion may be arranged to maintain a longitudinal arch of a sole and a whole of a calcaneus may be supported at two locations including the calcaneal anterior part and a rear part of the calcaneus.

In the above-described configuration, the calcaneal anterior-part support protrusion may be downwardly inclined toward both-side edges and along a forward-and-backward direction.

In the above-described configuration, the calcaneal anterior-part support protrusion may be downwardly inclined while including a region corresponding to a navicular bone.

In the above-described configuration, a cuboid bone support protrusion may be included which is capable of supporting a cuboid bone so that a motion of a calcaneocuboidal joint is not disturbed while maintaining a longitudinal arch of a sole.

In the above-described configuration, the cuboid bone support protrusion may be downwardly inclined toward both-side edges and along a forward-and-backward direction.

In the above-described configuration, the cuboid bone support protrusion may be downwardly inclined while including a region corresponding to a navicular bone.

In the above-described configuration, the calcaneal anterior-part support protrusion may overlap the cuboid bone support protrusion.

In the above-described configuration, a surface layer may be arranged on the cuboid bone support protrusion and the calcaneal anterior-part support protrusion so that an insole body is formed in multilayer.

In the above-described configuration, the calcaneal anterior-part support protrusion is arranged to enable support of a long plantar ligament.

In the above-described configuration, the calcaneal anterior-part support protrusion is formed of a material different in physical property from other portions, and when a foot is placed to allow the other portions to sink, the calcaneal anterior-part support protrusion may support the calcaneal anterior part from a sole.

In the above-described configuration, the cuboid bone support protrusion is formed of a material different in physical property from other portions, and when a foot is placed to allow the other portions to sink, the cuboid bone support protrusion may support the cuboid bone from a sole.

Advantageous Effects of Invention

According to the present invention, a calcaneal anterior part, which serves an important role in a longitudinal arch, a pronation and a supination and which is an essential and important part to support a weight of a user, is supported in a state where a foot movement is permitted, for example, and thus, a calcaneus is stabilized, and a whole of a tarsal bone including the calcaneus is stabilized in a natural state.

BRIEF DESCRIPTION OF DRAWINGS

FIG. 3 is a transverse sectional view showing an insole, FIG. 3(A) being a cross sectional view taken along S1-S1 in FIG. 2, FIG. 3(B) being a cross sectional view taken along S2-S2 in FIG. 2, FIG. 3(C) being a cross sectional view taken along S3-S3 in FIG. 2, FIG. 3(D) being a cross sectional view taken along S4-S4 in FIG. 2, and FIG. 3(E) being a cross sectional view taken along S5-S5 in FIG. 2.

DESCRIPTION OF EMBODIMENTS

With reference to the drawings, embodiments of the present invention will be described, below.

Figure 1:
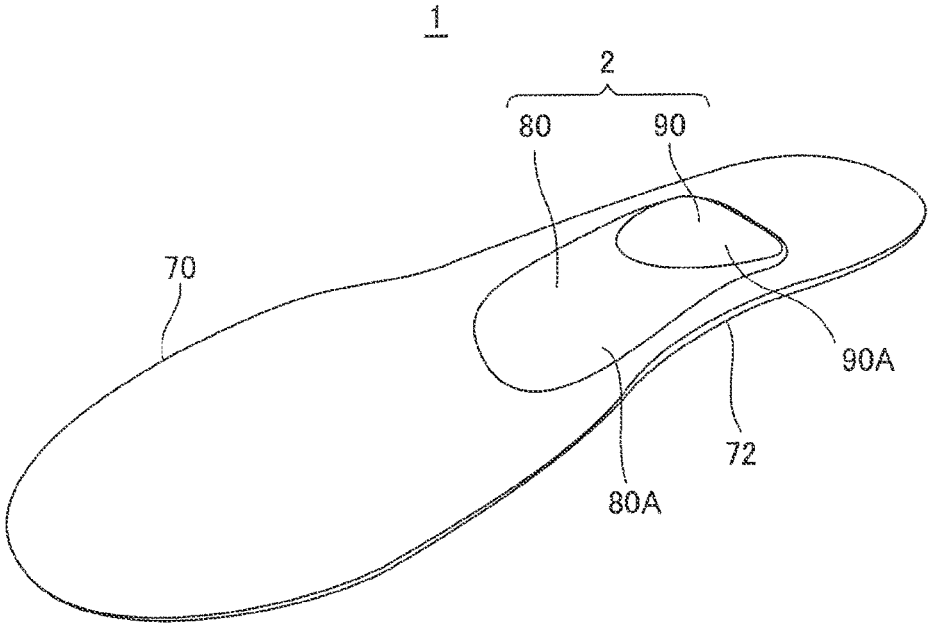
FIG. 1 is a perspective view showing an insole according to an embodiment of the present invention.

FIG. 1 is a perspective view showing an insole according to the present embodiment.

An insole (insole for a shoe) 1 has a shape formed along an inner contour of a shoe in a plan view, and includes an outer contour 70 received in the interior of a shoe. When the outer contour 70 adapts to the inner contour of a shoe, the insole 1 is fitted, when the insole 1 is inserted, at a predetermined position in the shoe. The shape of a foot of a user who uses the insole 1 differs depending on each individual and is not constant, and thus, a whole size of the insole 1 is selected in accordance with the size of a foot of a user. Further, the thickness in each region of the insole 1 can be changed to provide difference in thickness for each region of the insole 1. The insole 1 will have versatility when, for the insole 1, a plurality of types of thicknesses and a plurality of types of sizes are prepared.

When the insole 1 has the thickness adjusted, unevenness (a depression and protrusion 2) is formed on a top surface of the insole 1 on the side in contact with a foot. Further, lightened parts 72, 74 (see FIG. 3) are formed in the insole 1 to facilitate deformation of the insole 1.

It is noted that the irregularity may be formed on a top surface material as follows: a flat insole is previously prepared, and a separate protrusion 2 is detachably fitted to the top surface of the flat insole; or the insole is arranged to be a multilayer, and the protrusion 2 is fitted to an intermediate layer.

Next, in order to describe a configuration and a functional operation of the insole 1 of the present embodiment, a skeletal structure of a foot will be described.

Figure 2:
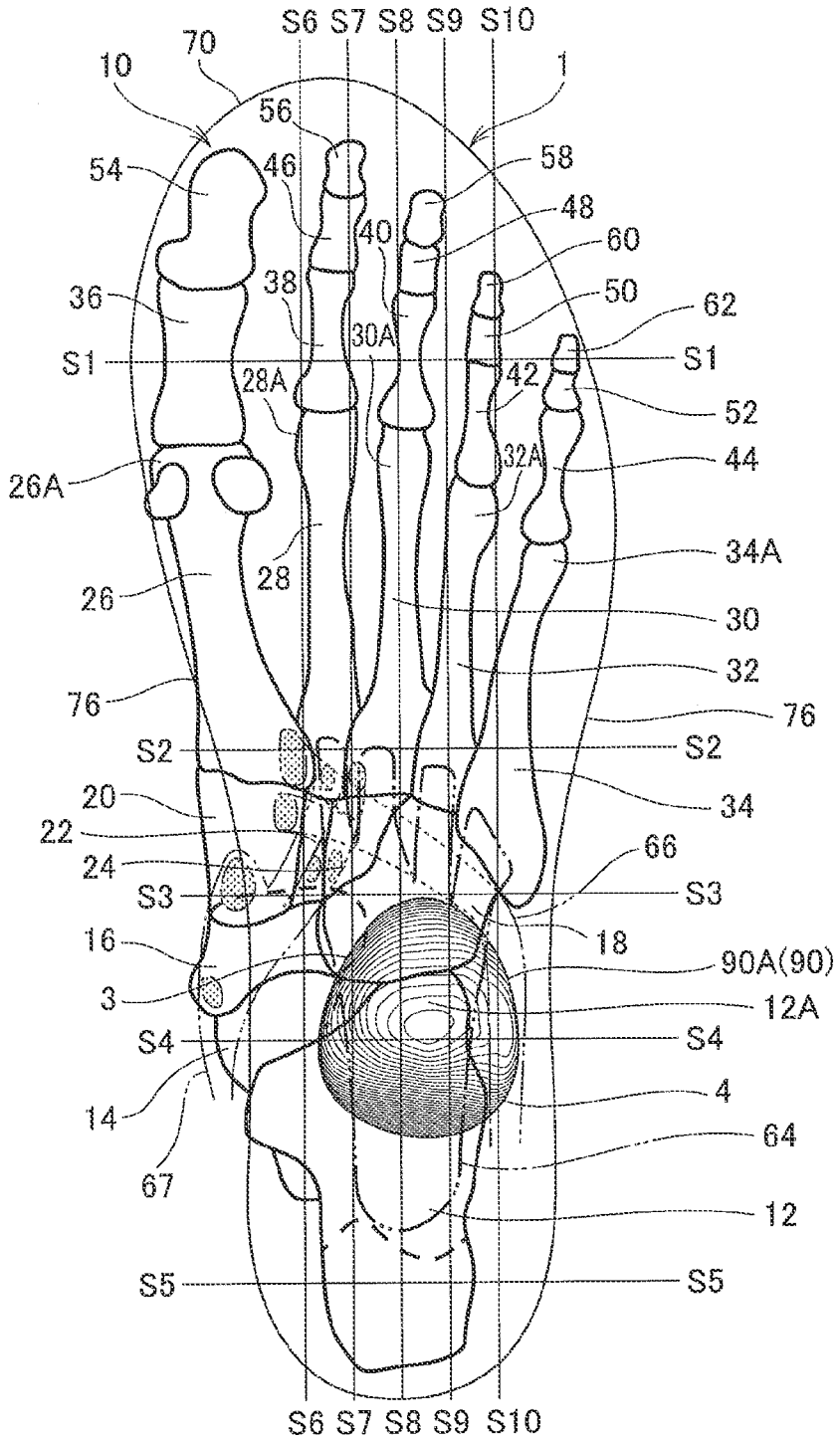
FIG. 2 is a bottom view showing an insole with a skeleton of a foot placed thereon.

FIG. 2 is a bottom view showing the insole 1 with a skeleton of a foot placed thereon. Note that this view is a view seen from below, and bones are partially hidden because the bones overlap one another. In a plain view seen from the top of a foot, the bones overlap differently from the bottom view of FIG. 2.

As shown in FIG. 2, the skeletal structure of a foot 10 is configured by: a calcaneus 12, a talus 14, a navicular bone 16, a cuboid bone 18, first to third cuneiform bones 20, 22, 24, first to fifth metatarsal bones 26, 28, 30, 32, 34, first to fifth proximal phalanxes 36, 38, 40, 42, 44, second to fifth middle phalanxes 46, 48, 50, 52, and first to fifth distal phalanxes 54, 56, 58, 60, 62. Front end parts of the first to fifth metatarsal bones 26, 28, 30, 32, 34 are first to fifth metatarsal bone head parts 26A (also called thenar 26A), 28A, 30A, 32A, and 34A (also called hypothenar 34A). A stepped part positioned at a front part of the calcaneus 12 is a calcaneal anterior part (also called calcaneal tubercle) 12A. It is noted that, in FIG. 2, in the navicular bone 16 only, a part hidden as a result of bones overlapping is indicated by a dotted line.

Further, the sole of foot has a transverse arch, and an inner (medial) longitudinal arch and an outer (lateral) longitudinal arch extending in a direction orthogonal to the transverse arch. The transverse arch is formed of the first to fifth metatarsal bones 26 to 34. Further, the inner longitudinal arch is configured by: the calcaneus 12, the talus 14, the navicular bone 16, the three cuneiform bones 20 to 24, and the first to third metatarsal bones 26 to 30. The outer longitudinal arch is configured by: the calcaneus 12, the cuboid bone 18, and the fourth to fifth metatarsal bones 32, 34.

On the top surface of the insole 1, as shown in FIG. 1 and FIG. 2, a cuboid bone support protrusion 80 and a calcaneal anterior-part support protrusion 90 configuring the protrusion 2 are formed. The cuboid bone support protrusion 80 is arranged in a portion corresponding to the cuboid bone 18, and the calcaneal anterior-part support protrusion 90 is arranged in a region corresponding to the calcaneal tubercle 12A. The cuboid bone support protrusion 80 and the calcaneal anterior-part support protrusion 90 are formed to be solid.

In the present embodiment, the calcaneal anterior-part support protrusion 90 is arranged on the cuboid bone support protrusion 80, and the top surface of the calcaneal anterior-part support protrusion 90 overlaps the top surface of the cuboid bone support protrusion 80 to form one protrusion 2. The cuboid bone support protrusion 80 and the calcaneal anterior-part support protrusion 90 may be integrated together, or separate bodies, and/or may be formed separately of a flat insole as described above. It is noted that, in FIG. 2, the calcaneal anterior-part support protrusion 90 is shown schematically together with a contour line indicating the height of the calcaneal anterior-part support protrusion 90.

With reference to FIG. 2 to FIG. 4, the cuboid bone support protrusion 80 and the calcaneal anterior-part support protrusion 90 will be described in detail, below.

Figures 4A, 4B, 4C, 4D, 4E:
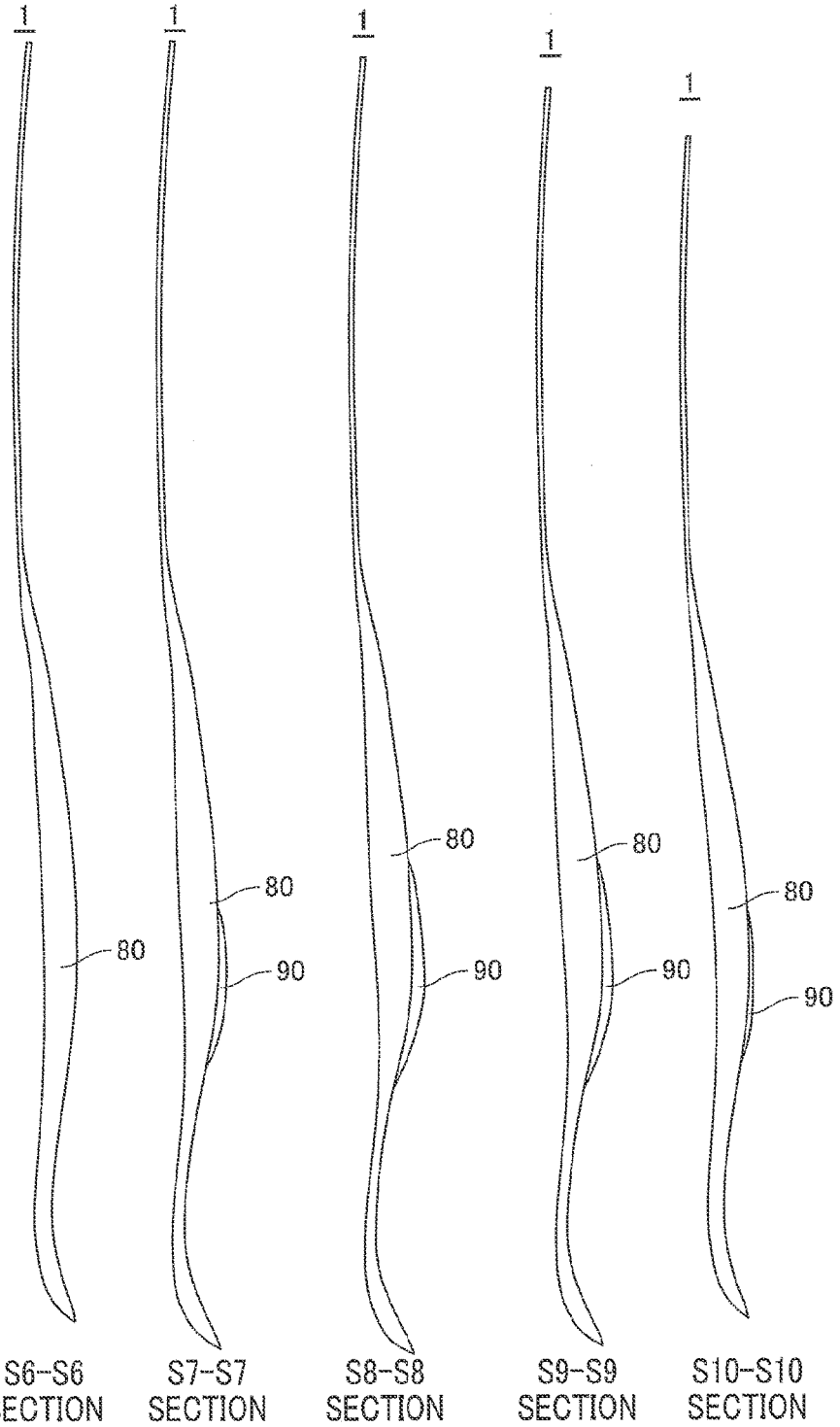
FIG. 4 is a longitudinal sectional view showing an insole, FIG. 4(A) being a cross sectional view taken along S6-S6 in FIG. 2, FIG. 4(B) being a cross sectional view taken along S7-S7 in FIG. 2, FIG. 4(C) being a cross sectional view taken along S8-S8 in FIG. 2, FIG. 4(D) being a cross sectional view taken along S9-S9 in FIG. 2, and FIG. 4(E) being a cross sectional view taken along S10-S10 in FIG. 2.
Figure 5:
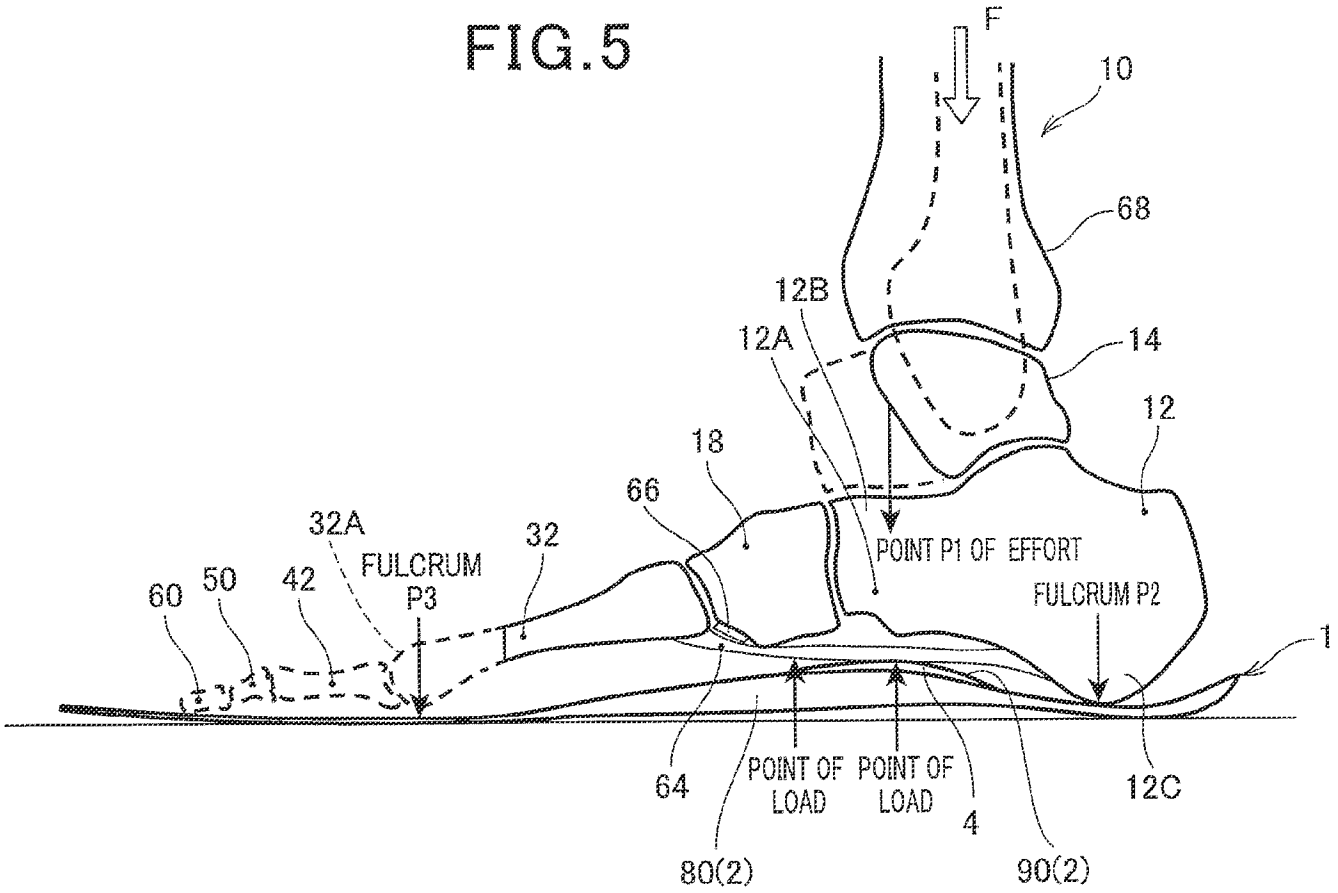
FIG. 5 is a longitudinal sectional view showing a relationship between an insole and a foot, where the insole is the same as that in the cross sectional view taken along S9-S9 in FIG. 2.

FIG. 3 is a transverse sectional view showing the insole 1, FIG. 3(A) being a cross sectional view taken along S1-S1 in FIG. 2, FIG. 3(B) being a cross sectional view taken along S2-S2 in FIG. 2, FIG. 3(C) being a cross sectional view taken along S3-S3 in FIG. 2, FIG. 3(D) being a cross sectional view taken along S4-S4 in FIG. 2, and FIG. 3(E) being a cross sectional view taken along S5-S5 in FIG. 2. FIG. 4 is a longitudinal sectional view showing the insole 1, FIG. 4(A) being a cross sectional view taken along S6-S6 in FIG. 2, FIG. 4(B) being a cross sectional view taken along S7-S7 in FIG. 2, FIG. 4(C) being a cross sectional view taken along S8-S8 in FIG. 2, FIG. 4(D) being a cross sectional view taken along S9-S9 in FIG. 2, and FIG. 4(E) being a cross sectional view taken along S10-S10 in FIG. 2. FIG. 5 is a longitudinal sectional view showing a relationship between the insole 1 and a foot, where the insole 1 is the same as that in the cross sectional view taken along S9-S9 in FIG. 2. FIG. 1 to FIG. 5 of the present embodiment show the insole 1 for a right foot and a skeleton of a right foot, and the insole 1 for a left foot and a skeleton of a left foot are subject to a mirror image.

With reference to the transverse sectional views in FIG. 1 and FIG. 3, the insole 1 has a flat top surface and bottom surface crossing near the proximal phalanxes 36 to 44 on the S1-S1 cross section. Although differing from person to person, a foot, the insole 1, and a shoe contact with one another over a substantially whole surface. There are no lightened parts 72, 74 on the S1-S1 cross section.

The S2-S2 cross section is a region corresponding to the transverse arch crossing the metatarsal bones 26 to 34, and the insole 1 has, on S2-S2 the cross section, a large thickness at the region corresponding to an arch of a foot to correspond to a general foot and the insole 1 at a top surface side thereof is downwardly inclined toward an outer side of a right foot so that the thickness is gradually decreased. Further, on the reverse surface of left and right inner and outer sides, the lightened parts 72, 74 are formed on both sides of a flat part so that it is possible to permit a slight deformation along a left-and-right direction on the S2-S2 cross section.

The S3-S3 cross section is a region corresponding to the cuboid bone 18, the cuboid bone support protrusion 80 having the largest thickness is provided at the S3-S3 cross section. A top surface 80A of the cuboid bone support protrusion 80, including an area from a region corresponding to the cuboid bone 18, toward both left and right side edges 76, to a region 3 (FIG. 2) corresponding to the navicular bone 16, is downwardly inclined so as to be gradually decreased in thickness. On the S3-S3 cross section, there is a raised edge 78 at the outermost edge of the insole 1. In FIG. 3, the level of a gradual decrease in thickness at a top surface side along a left-and-right direction is barely seen; this is to adapt to the shape of an arch of a foot provided in a foot. In other words, when a foot is inserted into a shoe fitted with the insole 1 and then an upright standing posture is maintained, the cuboid bone support protrusion 80 corresponding to the cuboid bone 18 exerts a maximum stress on the foot sole surface. The insole 1 is configured so that the stress is slowly and gradually decreased from the cuboid bone support protrusion 80, including a region corresponding to the navicular bone 16, along a left-and-right direction.

Further, as the configuration at a bottom surface side of the insole 1, a region in contact with a shoe is flat in a region corresponding to the cuboid bone 18, that is, at a reverse side of the cuboid bone support protrusion 80. Such a configuration allows the reaction force to be constantly exerted on the cuboid bone 18 from a shoe. At reverse sides of left and right inner and outer sides, the lightened parts 72, 74 are formed. As compared to the above-described S2-S2 cross section and an S4-S4 cross section described later, the lightened parts 72, 74 of the S3-S3 cross section are large, reach largest at both sides corresponding to the cuboid bone 18, and the lightened parts 72, 74 are reduced in size along a forward-and-backward direction. Not only when the top surface side on the S3-S3 cross section is inclined downwardly toward the both-side edges 76 but also when the lightened parts 72, 74 are made large, the insole 1 becomes easily deformed in a region shifted to both sides from the cuboid bone support protrusion 80, and the stress exerted on a foot is gradually decreased along a left-and-right direction as apart from the cuboid bone support protrusion 80.

The S4-S4 cross section, which crosses the calcaneal tubercle 12A, is a region corresponding to a longitudinal arch backward final point, and the calcaneal anterior-part support protrusion 90 having the largest thickness is provided at the S4-S4 cross section. The top surface 90A of the calcaneal anterior-part support protrusion 90, including an area from a region corresponding to the calcaneal tubercle 12A, toward left and right both-side edges 76, to a region 3 (FIG. 2) corresponding to the navicular bone 16, is downwardly inclined so as to be gradually decreased in thickness. In other words, the insole 1 is configured so that the stress is slowly and gradually decreased along a left-and-right direction as apart from the calcaneal anterior-part support protrusion 90. Further, in the insole 1, the top surface side is, on the S4-S4 cross section, upwardly inclined toward the both sides so that a thickness of the insole 1 gradually increases, and the insole 1 has the raised edge 78 at the outermost edge. On the reverse surface of left and right inner and outer sides, the lightened parts 72, 74 are formed on both sides of a flat part so that it is possible to permit a slight deformation along a left-and-right direction on the S4-S4 cross section.

The S5-S5 cross section, which crosses a rear part of the calcaneus 12, is a region corresponding to a longitudinal arch backward final point. The top surface side of the insole 1 is, on the S5-S5 cross section, relatively flat so as to support a heel to correspond to a general foot. Further, in the insole 1, the top surface side is, on the S5-S5 cross section, upwardly inclined toward the both sides so that a thickness of the insole 1 gradually increases, and the insole 1 has the raised edge 78 at the outermost edge. On the reverse surface of left and right inner and outer sides, the lightened parts 72, 74 are formed so that it is possible to permit a slight deformation along a left-and-right direction on the S5-S5 cross section.

With reference to the longitudinal sectional view of FIG. 4, on the S6-S6 cross section and the S7-S7 cross section, a top surface of the insole 1 is raised in a region corresponding to the cuneiform bones 20 to 24 and the navicular bone 16 configuring the inner longitudinal arch. The insole 1 of the present invention supports not only a region corresponding to the cuboid bone 18 and the calcaneal tubercle 12A but also other portions in view of stability. However, such a configuration does not restrain a foot movement.

Thus, as described with reference to the S2-S2 cross section to the S4-S4 cross section, the lightened part 72 is arranged as shown on the S6-S6 cross section and the S7-S7 cross section, and the insole 1 is configured to be capable of subsiding inside of the cuboid bone support protrusion 80. As described with reference to the S3-S3 cross section, even when force is exerted on a region corresponding to the cuneiform bones 20 to 24 and the navicular bone 16, the insole 1 is deformed by the lightened part 72 to alleviate the exerted stress.

The S7-S7 cross section to the S9-S9 cross section are regions corresponding to the cuboid bone 18, and the cuboid bone support protrusion 80 having the largest thickness is provided at the S7-S7 cross section and the S9-S9 cross section. The top surface 80A of the cuboid bone support protrusion 80, which is downwardly inclined along a forward-and-backward direction from a region corresponding to the cuboid bone 18, is gradually decreased in thickness. In other words, when a foot is inserted into a shoe fitted with the insole 1 and then an upright standing posture is maintained, the cuboid bone support protrusion 80 corresponding to the cuboid bone 18 exerts a maximum stress on the foot sole surface. The insole 1 is configured so that the stress is slowly and gradually decreased along a forward-and-backward direction as apart from the cuboid bone support protrusion 80.

Further, as the configuration at a bottom surface side of the insole 1, a region in contact with a shoe is flat in a region corresponding to the cuboid bone 18, that is, at a reverse side of the cuboid bone support protrusion 80. Such a configuration allows the reaction force to be constantly exerted on the cuboid bone 18 from a shoe.

The S8-S8 cross section and the S9-S9 cross section are regions corresponding to the calcaneal tubercle 12A and the calcaneal anterior-part support protrusion 90 having the largest thickness is provided at the S8-S8 cross section and the S9-S9 cross section. The top surface 90A of the calcaneal anterior-part support protrusion 90, which is downwardly inclined along a forward-and-backward direction from a region corresponding to the calcaneal tubercle 12A, is gradually decreased in thickness. In other words, the insole 1 is configured so that the stress is slowly and gradually decreased along a forward-and-backward direction as apart from the calcaneal anterior-part support protrusion 90.

Further, as the configuration at a bottom surface side of the insole 1, a region in contact with a shoe is flat in a region corresponding to the calcaneal tubercle 12A, that is, at a reverse side of the calcaneal anterior-part support protrusion 90. This configuration allows the reaction force to be constantly exerted on the calcaneal tubercle 12A from a shoe.

At the S10-S10 cross section, a top surface is raised in a region corresponding to the fifth metatarsal bone 34 configuring the outer longitudinal arch. The region is located outside the cuboid bone support protrusion 80 and the calcaneal anterior-part support protrusion 90, and is slightly bulged in view of stability. However, such a configuration does not restrain a foot movement.

The lightened part 74 is arranged in a region corresponding to the outer longitudinal arch, and the insole 1 is rendered capable of subsiding also outside the cuboid bone support protrusion 80 and the calcaneal anterior-part support protrusion 90. As described with reference to the S3-S3 cross section, even when force is exerted on the fifth metatarsal bone 34 of the outer longitudinal arch, the insole 1 is deformed by the lightened part 74 to alleviate the exerted stress.

As described with reference to the transverse section of FIG. 3 and the longitudinal section of FIG. 4, when the insole 1 is downwardly inclined along front-back and left-right radial directions around the cuboid bone support protrusion 80, the cuboid bone 18 is intensively supported, and in a foot region shifted in front-back and left-right directions from the cuboid bone 18, the stress exerted on the region is gradually decreased. Thus, as described below, it is possible to maintain a normal posture and improve a movement function.

Further, a foot is supported from a sole in a region corresponding to the cuboid bone 18, and the insole is downwardly inclined along the left-right and front-back directions around the cuboid bone 18, and further, lightened parts 72, 74 are arranged to permit a movement, whereby a stimulation is applied which leads a user him/herself to return with each foot to a normal posture through centering around the cuboid bone 18.

When a partial joint is focused, it is possible to divide a bone of a foot into a Chopart's joint and a Lisfranc's joint. The Chopart's joint is a joint at a heel side in a foot part, in FIG. 2, the Chopart's joint is a joint including the calcaneus 12, the talus 14, the navicular bone 16, and the cuboid bone 18. On the other hand, the Lisfranc's joint is a joint at a toe side in a foot part, and in FIG. 2, is a joint including the cuboid bone 18, the first to third cuneiform bones 20 to 24, and the first to fifth metatarsal bones 26 to 34.

The cuboid bone 18 is the only bone that simultaneously configure the Chopart's joint and the Lisfranc's joint, and is located in an important region. When the cuboid bone 18 is not located at a correct position any more as a result of a muscular strength being weakened or a ligament being loosened, the Chopart's joint and/or the Lisfranc's joint are distorted. This distortion causes a forefoot evagination or a forefoot inversion. When the foot is supported around the cuboid bone 18, it is possible to resolve the distortion of the Chopart's joint and the Lisfranc's joint, and it is possible to maintain a normal posture.

Further, given the nature of a joint, a movement function is inhibited when the joint is fixedly supported only. Thus, it is also necessary to permit a movement and the insole 1 is configured so that the top surface is downwardly inclined along a radial direction around the cuboid bone support protrusion 80 to alleviate the stress, and thus, it is possible to permit a movement of the both joints.

Next, when a functional aspect is focused, it can be seen that a foot bone is configured by an inner compartment governing a motility and an outer compartment relating to a stability. The inner compartment is a group of bones including the talus 14, the navicular bone 16, the cuneiform bones 20 to 24, the metatarsal bones 26 to 30 in first toe to third toe, the proximal phalanxes 36 to 40, the middle phalanxes 46, 48, and the distal phalanxes 54 to 58, and is mainly used for movement such as running and stopping. On the other hand, the outer compartment is a group of bones including the calcaneus 12, the cuboid bone 18, the metatarsal bones 32, 34 in the fourth toe and the fifth toe, the proximal phalanxes 42, 44, the middle phalanxes 50, 52, and the distal phalanxes 60, 62, and is used for supporting a body in an upright standing posture.

The cuboid bone 18 is the center of the outer compartment, and is structured to support from below the navicular bone 16 which is the center of the inner compartment and the cuneiform bones 20 to 24. FIG. 2 is a bottom view, and thus, the cuboid bone 18 is hidden behind the talus 14 and the navicular bone 16. In view of structure, the force applied to all the skeletons is concentrated in the cuboid bone 18. Thus, when the cuboid bone 18 is unstable, a whole foot has low rigidity to be easily distorted, and as a result, the force is not easily transmitted.

The force applied to the foot leads to stress concentration on the cuboid bone 18, and thus, when the cuboid bone 18 is supported from below, it is possible to prevent an excessive distortion due to an increased rigidity over a whole foot, and to make a transmission of force easy. Further, both the pronation and the supination of a foot involve a decrease in a height of the cuboid bone 18 in a downward direction; however, when the cuboid bone 18 is supported from below at an ideal position, it is possible to reproduce a neutral position to also improve the movement function.

Here, when the cuboid bone 18 is supported only, the calcaneus 12 is not stabled, and the cuboid bone 18, the calcaneus 12, and the joint (calcaneocuboidal joint) may be distorted. The calcaneocuboidal joint configures a part of the Chopart's joint.

Further, the calcaneus 12 configures simultaneously both the inner longitudinal arch and the outer longitudinal arch, and thus, when the calcaneus 12 is not stabled, it is not possible to maintain the longitudinal arch at a normal position. In particular, the calcaneal tubercle 12A at the front of the calcaneus 12 is positioned so that the long plantar ligament 64 linking an intermediate part of the calcaneus 12 and the second to fifth metatarsal bones 28 to 34 overlaps, as shown in FIG. 5. The long plantar ligament 64 functions also to maintain the longitudinal arch.

Therefore, when the calcaneal tubercle 12A is supported via the long plantar ligament 64 by the calcaneal anterior-part support protrusion 90, the calcaneus 12 is stabled, as a result of which it is possible to reduce the distortion of the calcaneocuboidal joint and locate the longitudinal arch at a normal position. Thus, the longitudinal arch functions more effectively as a spring. In particular, as compared to mid-day, the function of maintaining the longitudinal arch of the long plantar ligament 64 is decreased at night, and thus, it is effective to support the long plantar ligament 64. That is, the calcaneal anterior-part support protrusion 90 includes a region 4 corresponding to the calcaneal tubercle 12A at a position at which the long plantar ligament 64 overlaps.

Further, the calcaneal anterior-part support protrusion 90 supports the long plantar ligament 64 not only to promote the passive stability of the arch of a foot but also to support a tendon of insertion 66 of a long fibular muscle which is important in actively stabilizing the outer longitudinal arch via the long plantar ligament 64. Here, the passive stabilization is achieved by a ligament and the active stabilization is achieved by a muscle (tendon). As shown in FIG. 2, the tendon of insertion 66 of the long fibular muscle extends along the cuboid bone 18, then crosses the sole of foot from an outer edge of a foot, and reaches the bottom of the first cuneiform bone 20 and the first metatarsal bone 26. Further, a part of the calcaneal anterior-part support protrusion 90 is located beneath the cuboid bone 18, and supports the navicular bone 16 via the cuboid bone 18. Thus, a tendon of insertion 67 of a posterior tibial muscle, which is a main active stabilization structure of the inner longitudinal arch is indirectly supported. The tendon of insertion 67 of the posterior tibial muscle allows the fascia to extend to the first to third cuneiform bones 20, the second to third metatarsal bones 28, 30, and the navicular bone 16. When the two muscles, that is, the long fibular muscle and the posterior tibial muscle, extend diagonally, the longitudinal arch, in addition to the transverse arch, are held.

On the other hand, the calcaneal anterior-part support protrusion 90 is configured to not support a belly muscle part of the long fibular muscle and the posterior tibial muscle. Likewise, an influence, caused by the calcaneal anterior-part support protrusion 90, to a belly muscle position of a musculus brevis of a foot (an abductor muscle of great toe, a musculus flexor hallucis brevis, a musculus flexor digitorum brevis, and an abductor muscle of little finger) involved with the active stabilization of the longitudinal arch is small. That is, the calcaneal anterior-part support protrusion 90 is configured to not inhibit the active stabilization while improving the passive stabilization of an arch of a foot.

Further, the calcaneus 12 also configures the joint, and thus, a movement function is inhibited when the calcaneus 12 is only fixedly supported. As a result, it is necessary to permit a movement. The insole 1 is configured so that the top surface is downwardly inclined along a radial direction around the cuboid bone support protrusion 80 to alleviate the stress, and thus, it is possible to permit a movement of a joint configured by the calcaneus 12. More specifically, the calcaneal anterior-part support protrusion 90 is formed of a relatively soft material, and a part having the maximum thickness is sunk by the weight of a user so that the calcaneal tubercle 12A is supported. When the calcaneal anterior-part support protrusion 90 is sunk, the insole 1 is downwardly inclined along front-back and left-right radial directions around the cuboid bone support protrusion 80, whereby the foot is supported with the cuboid bone 18 being a fulcrum and a foot movement is permitted around the cuboid bone support protrusion 80.

Further, a weight F of a user is exerted on the calcaneus 12 via the talus 14 from a tibia 68, and thus, the calcaneus 12 acts as an essential and important part to support the weight of the user. In the calcaneus 12, a calcaneal front-side upper end 12B acts as a point P1 of effort and a calcaneal lower end (calcaneal rear part) 12C acts as a fulcrum P2, and thus, a moment around the fulcrum P2 is exerted on the calcaneus 12. Therefore, when the calcaneal tubercle 12A approximately immediately below the point P1 of effort is supported, it is possible to stabilize the calcaneus 12. Further, the calcaneal tubercle 12A is at a distance L1 from the calcaneal lower end 12C as the fulcrum P2, and thus, when the calcaneal anterior-part support protrusion 90 is arranged in a region corresponding to the calcaneal tubercle 12A, it is possible to efficiently support the calcaneus 12 with small force.

The weight F of a user is exerted also on the cuboid bone 18 via the calcaneus 12. In the cuboid bone 18, the first to fifth metatarsal bone head parts 26A to 34A act as a fulcrum P3, and thus, a moment around the fulcrum P3 is exerted on the cuboid bone 18. When the cuboid bone 18 approximately immediately below the point P1 of effort is supported, it is possible to stabilize the cuboid bone 18. Further, the cuboid bone 18 is at a distance L2 from the first to fifth metatarsal bone head parts 26A to 34A as the fulcrum P3, and thus, when the cuboid bone support protrusion 80 is arranged in a region corresponding to the cuboid bone 18, it is possible to efficiently support the cuboid bone 18 with small force.

Figure 6:
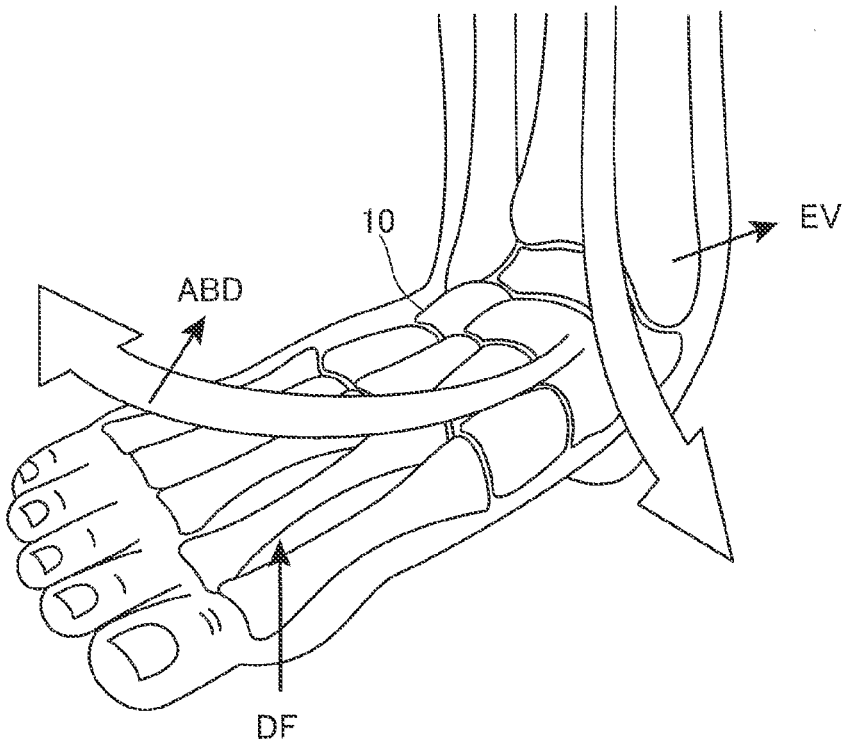
FIG. 6 is a perspective view showing a pronation.
Figure 7:
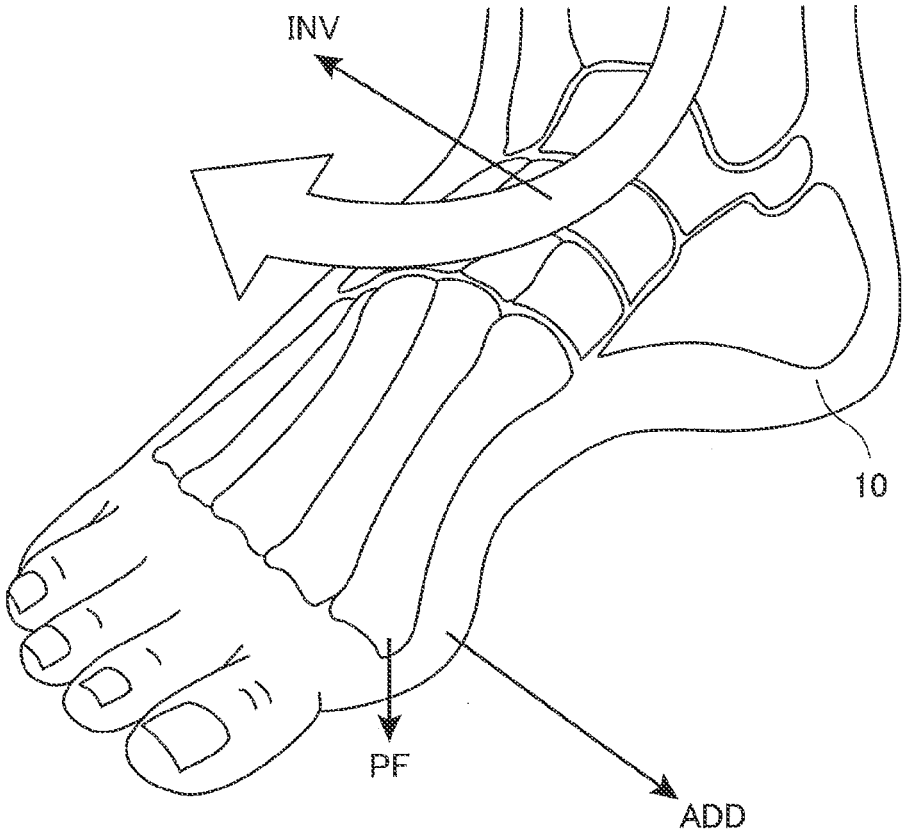
FIG. 7 is a perspective view showing a supination.

Next, types of movement of a foot are focused. FIG. 6 is a perspective view showing a pronation. FIG. 7 is a perspective view showing a supination.

The pronation is a motion involving an abduction ABD, a dorsiflexion DF, and an evagination EV of a foot part, as shown in FIG. 6, and is a motion in which a whole of a foot is twisted inwardly. The supination is a motion opposite to the pronation, as shown in FIG. 7, and is a motion in which a whole of a foot is twisted outwardly, involving an adduction ADD, a plantar flexion PF, and an inversion INV of a foot part.

When the foot pronates, the tibia (bone of a shank) performs the internal rotation (inward rotation). In linkage with the internal rotation of the tibia, a femur (bone of a thigh) also performs the internal rotation. When the foot supinates, the tibia performs an external rotation (outward rotation). In linkage with the external rotation of the tibia, the femur also performs the external rotation. To normal walk or exercise, an adequate pronation or supination is a vital motion, and a distortion of a foot is caused by an excessive pronation (abduction, dorsiflexion, and evagination=inwardly twisting motion) and supination (adduction, plantar flexion, and inversion=outwardly twisting motion).

The insole 1 (FIG. 1) of the present embodiment is designed to not only simply support an area near the cuboid bone 18 by the cuboid bone support protrusion 80 but also permit each movement. The insole 1 is formed to support from below a region equivalent to the cuboid bone 18 so as to smoothly guide the pronation and the supination while correcting and preventing an excessive distortion of a skeleton of a foot. That is, when the insole 1 is fitted, the cuboid bone 18 is supported while the cuboid bone support protrusion 80 acts as an apex. The cuboid bone 18 is supported from below, and thus, the foot maintains a neutral position relative to the left-right and front-back directions, and at the same time, with the cuboid bone 18 being a fulcrum, the evagination is permitted in the pronation and the inversion is permitted in the supination. Thus, the insole 1 does not disturb a normal motion of a joint, it is only slightly needed to make a compensation in other regions, and a travel of the center of gravity along front-back and left-right directions is facilitated. That is, unlike a plaster cast, the insole 1 does not fixedly restrain a foot, but alleviates the stress by having a top surface thereof being downwardly inclined along a radial direction from the cuboid bone support protrusion 80, and further, includes the lightened parts 72, 74 to facilitate deformation of the insole 1 itself, whereby a movement is permitted.

Further, the calcaneus 12 acts an important role in the dorsiflexion DF and the evagination EV of the pronation, and the plantar flexion PF and the inversion INV of the supination, and thus, when the calcaneus 12 is supported, the dorsiflexion DF and the evagination EV of the pronation, and the plantar flexion PF and the inversion INV of the supination are stabilized.

During an ordinal walking, when a walking location is a gravel path, stairs, or has irregularities, or inclined, etc., the calcaneus 12 is inclined by 10° in the evagination EV and by 20° in the inversion INV, for example. Therefore, when the calcaneus 12 is supported by the cuboid bone support protrusion 80, it is possible to stabilize the motion of a foot not only in a hard exercise such as a sport but also in an ordinal walking.

As described above, according to the present embodiment, a configuration is to include the calcaneal anterior-part support protrusion 90 for supporting the calcaneal tubercle 12A from the sole. This configuration allows to stabilize the calcaneus 12 which is an essential and important part to support a weight of a user and which serves an important role in a longitudinal arch, a pronation, and a supination, and a foot movement is permitted, it is thus possible to stabilize a whole of a tarsal bone including the calcaneus 12 in a natural state.

Further, according to the present embodiment, a configuration is that the calcaneal anterior-part support protrusion 90 is arranged to maintain a longitudinal arch on a sole, and a whole of the calcaneus 12 is supported at two locations including the calcaneal tubercle 12A and the calcaneal lower end 12C. That is, the calcaneal anterior-part support protrusion 90 supports the calcaneal tubercle 12A while maintaining the longitudinal arch on the sole, and as a result, a whole of the calcaneus 12 is supported by the insole 1 at two locations including the calcaneal tubercle 12A and the calcaneal lower end 12C. It is possible to stably support a whole of the calcaneus 12 while maintaining the longitudinal arch. It is noted that when an insole with a heel side being omitted is concerned, a whole of the calcaneus 12 is supported at two locations including the calcaneal tubercle 12A and the calcaneal lower end 12C by the calcaneal anterior-part support protrusion 90 of the insole 1 and a shoe, respectively.

Further, according to the present embodiment, a configuration is to include the cuboid bone support protrusion 80 capable of supporting the cuboid bone 18 so that a motion of a calcaneocuboidal joint is not disturbed while maintaining a longitudinal arch at external side of a sole. In a state where an arch form including a calcaneocuboidal joint between the cuboid bone 18 and the calcaneus 12 is held and in a state where a foot movement is permitted, this configuration allows to stabilize the cuboid bone 18 and the calcaneus 12 to reduce a distortion of the calcaneocuboidal joint and stabilize a whole of a tarsal bone including the cuboid bone 18 and the calcaneus 12 in a natural state. This allows a joint of a foot to move freely, and thus, it is possible to enhance a function of a foot.

Further, according to the present embodiment, the calcaneal anterior-part support protrusion 90 is arranged to enable support of the long plantar ligament 64, and thus, when the calcaneal tubercle 12A is supported via the long plantar ligament 64 that maintains a longitudinal arch, it is possible to hold more stably the longitudinal arch.

Further, according to the present embodiment, a configuration is that the top surface 90A of the calcaneal anterior-part support protrusion 90 overlaps the top surface 80A of the cuboid bone support protrusion 80, and the calcaneal anterior-part support protrusion 90 is arranged on the cuboid bone support protrusion 80, and thus, it is possible to easily form the calcaneal anterior-part support protrusion 90.

However, the above-described embodiment is one aspect of the present invention, and naturally, it is possible to apply a modification, where appropriate, without departing from the spirit of the present invention.

Figure 8:
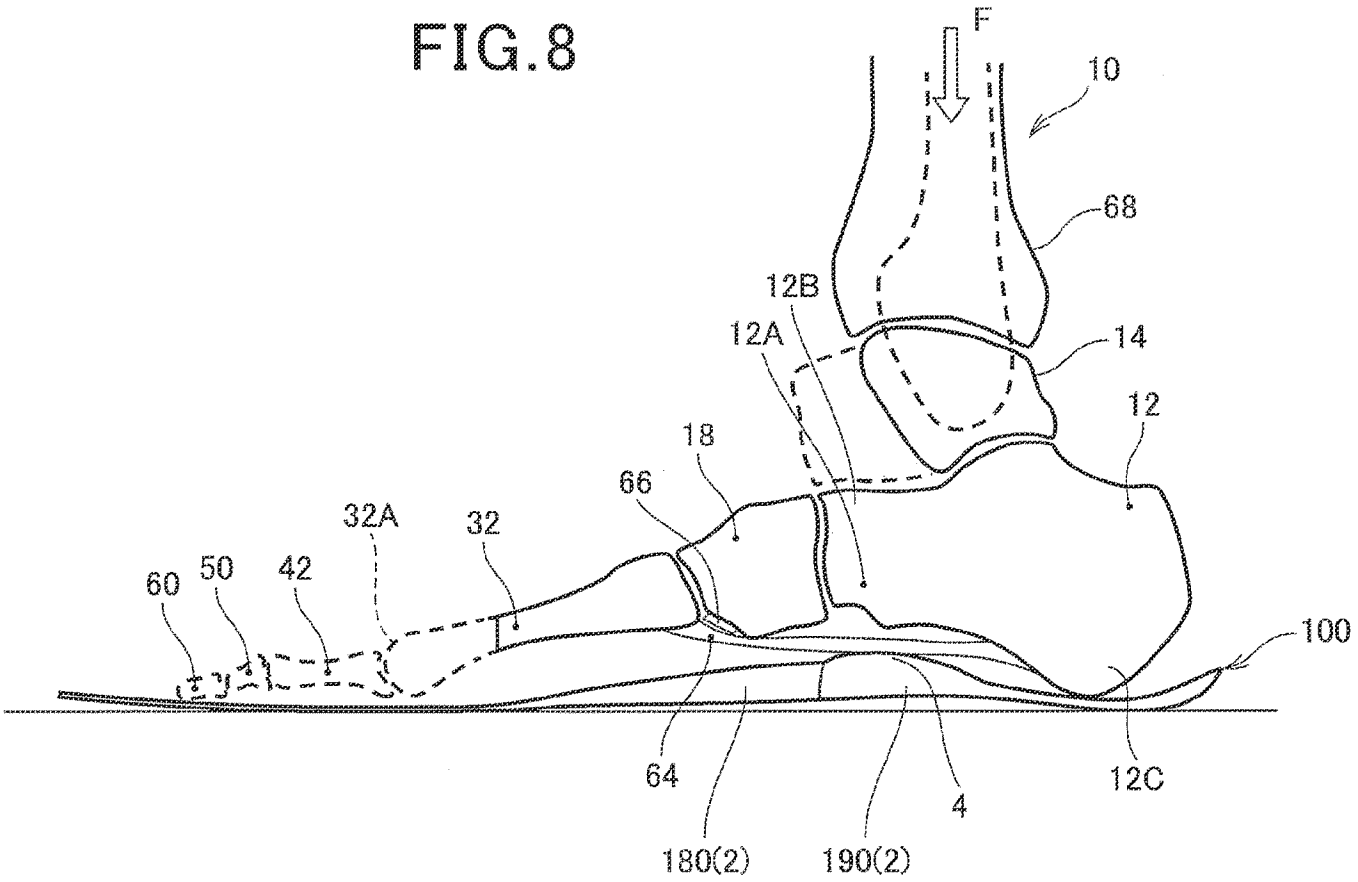
FIG. 8 is a longitudinal sectional view showing a relationship between an insole 100 according to a modification of the present invention and a foot.

For example, in the above-described embodiment, the cuboid bone support protrusion 80 that supports the cuboid bone 18 and the calcaneal anterior-part support protrusion 90 that supports the calcaneal tubercle 12A are integrated together to form the protrusion 2; however, as in an insole 100 shown in FIG. 8, a cuboid bone support protrusion 180 and a calcaneal anterior-part support protrusion 190 may be separate bodies. In this case, formation may be that the cuboid bone support protrusion 180 and the calcaneal anterior-part support protrusion 190 are inclined downwardly to include the region 3 corresponding to the navicular bone 16 toward the both-side edges 76, or gradually decrease the stress, the cuboid bone support protrusion 180 is inclined downwardly along a forward direction, or gradually decreases the stress, and the calcaneal anterior-part support protrusion 190 is inclined downwardly along a backward direction, or gradually decreases the stress. It is noted that, in FIG. 8, the same reference symbols are applied to the same parts as those in the insole 1 shown in FIG. 1 and description will be omitted.

Further, in this case, it is not necessary that the cuboid bone support protrusion 180 and the calcaneal anterior-part support protrusion 190 are coupled back to back, and there may be a gap between the cuboid bone support protrusion 80 and the calcaneal anterior-part support protrusion 90.

Further, in the above-described embodiment, the bottom surface of the insole 1 at the reverse side is configured to be flat at the cuboid bone support protrusion 80 and the calcaneal anterior-part support protrusion 90; however, the shape of the bottom surface of the insole 1 is not limited thereto.

Further, in the above-described embodiment, the cuboid bone support protrusion 80 and the calcaneus anterior-part support protrusion 90 are formed to be solid; however, the interior of the top surfaces 80A, 90A of the cuboid bone support protrusion 80 and the calcaneal anterior-part support protrusion 90 may be hollow.

In the above-described embodiment, the insole 1 approximately adapts to the internal shape of a shoe; however, the insole 1 may be of planar shape where a toe part is omitted as a so-called half size. A region where a thickness is needed in the insole 1 extends from a region corresponding to a rear transverse arch relative to a metatarsal bone part to an area near the calcaneus, and thus, the toe side and the heel side may be omitted.

Further, although omitted in the drawings, a surface layer maybe arranged on the cuboid bone support protrusion 80 and the calcaneal anterior-part support protrusion 90 so that an insole body is formed in multilayer.

Further, in the above-described embodiment, the cuboid bone support protrusion 80 and the calcaneal anterior-part support protrusion 90 are formed in a protrusion; however, the cuboid bone support protrusion 80 and the calcaneal anterior-part support protrusion 90 may be formed of a material different in physical property, from other portions, such as hardness, coefficient of rebound, and material quality to forma whole of the insole 1 in an approximately flat shape. In this case, when a foot is placed, other portions other than the cuboid bone support protrusion 80 and the calcaneal anterior-part support protrusion 90 are sunk, and as a result, the cuboid bone support protrusion 80 is formed to be a protrusion to support the cuboid bone 18 and the calcaneal anterior-part support protrusion 90 is formed to be a protrusion to support the calcaneal tubercle 12A.

An object of an insole for a shoe of the present invention is to improve an standing posture and enhance a movement function, and it is suitable to widely apply the insole for a shoe not only to a shoe used daily, but also to various types of shoes such as a shoe for sports which seeks for functionality such as ski and soccer, a medical shoe having a purpose of treatment and rehabilitation, and a training shoe having a purpose of promoting a health.

REFERENCE SIGNS LIST

1 insole (insole for shoe)
3 region
4 region

12 calcaneus
12A calcaneal tubercle (calcaneal anterior part)
16 navicular bone
18 cuboid bone
64 long plantar ligament
76 both-side edges
80 cuboid bone support protrusion
80A top surface
90 calcaneal anterior-part support protrusion
90A top surface

The invention claimed is:

1. An insole for a shoe, comprising:

a cuboid bone support protrusion having a first surface configured to support cuboid bone of a user's foot and a second surface opposite from the first surface, the first surface being arranged to at least partially contact a sole of the user's foot, the cuboid bone support portion being downwardly inclined toward both left and right side edges through centering around the region adapted to correspond to the cuboid bone while including an area from a region adapted to correspond to the cuboid bone to a region adapted to correspond to a navicular bone so as to be gradually decreased in thickness and which is downwardly inclined along a forward-and-backward direction from the region adapted to correspond to the cuboid bone through centering around the region adapted to correspond to the cuboid bone so as to be gradually decreased in thickness, whereby the cuboid bone support protrusion is gradually decreased in thickness along front-back and left-right radial directions through centering around the region adapted to correspond to the cuboid bone, a calcaneal anterior-part support protrusion which is provided on the first surface of the cuboid bone support protrusion, wherein a top surface of the calcaneal anterior-part support protrusion is configured to at least partially contact the sole of the user's foot and to overlap a top surface of the cuboid bone support protrusion, and the calcaneal anterior-part support protrusion includes a region configured to correspond to a calcaneal tubercle at a position that overlaps a long plantar ligament, the calcaneal anterior-part support protrusion being downwardly inclined along the forward-and-backward direction from the region adapted to correspond to the calcaneal tubercle so as to be gradually decreased in thickness, the calcaneal anterior-part support protrusion being configured to support the long plantar ligament at a position that overlaps the calcaneal tubercle, wherein the calcaneal anterior-part support protrusion is formed of a material such that a part having a maximum thickness in the calcaneal anterior-part support protrusion is sunk by a weight of a user and, whereby the calcaneal anterior-part support protrusion is configured to support the long plantar ligament at a position that overlaps the calcaneal tubercle in a state where a foot movement of the user's foot is permitted around the cuboid bone support protrusion to reduce distortion of a calcaneocuboidal joint to an outer longitudinal arch of the sole of the user's foot.

2. The insole for a shoe according to claim 1, wherein the calcaneal anterior-part support protrusion is configured to maintain the outer longitudinal arch of the sole and is configured to support a whole of a calcaneus at two locations including the calcaneal anterior part and a rear part of the calcaneus.

3. The insole for a shoe according to claim 1, wherein the calcaneal anterior-part support protrusion is downwardly inclined toward both-side edges and along a forward-and-backward direction.

4. The insole for a shoe according to claim 1, wherein a surface layer is arranged on the cuboid bone support protrusion and the calcaneal anterior-part support protrusion so that an insole body is formed in multilayer.

5. The insole for a shoe according to claim 1, wherein the calcaneal anterior-part support protrusion is formed of a material different in physical property from other portions, and when a foot is placed to allow the other portions to sink, the calcaneal anterior-part support protrusion supports the calcaneal anterior part from the sole.

6. The insole for a shoe according to claim 1, wherein the cuboid bone support protrusion is formed of a material different in physical property from other portions, and when a foot is placed to allow the other portions to sink, the cuboid bone support protrusion supports the cuboid bone from the sole.

* * * * *